US007688288B2

(12) United States Patent
Song et al.

(10) Patent No.: US 7,688,288 B2
(45) Date of Patent: Mar. 30, 2010

(54) METHOD FOR DRIVING PLASMA DISPLAY PANEL

(75) Inventors: Byung Soo Song, Goyang-si (KR); Chang Ho Hyeon, Yongin-si (KR)

(73) Assignee: LG Electronics Inc., Seoul (KR)

( * ) Notice: Subject to any disclaimer, the term of this patent is extended or adjusted under 35 U.S.C. 154(b) by 759 days.

(21) Appl. No.: 10/932,144

(22) Filed: Sep. 2, 2004

(65) Prior Publication Data

US 2005/0052360 A1 Mar. 10, 2005

(30) Foreign Application Priority Data

Sep. 4, 2003 (KR) ..... 10-2003-0061653

(51) Int. Cl.
*G09G 3/28* (2006.01)

(52) U.S. Cl. ..... 345/68; 345/60

(58) Field of Classification Search ..... 345/60–68, 345/53, 94; 348/441, 459; 315/169.4
See application file for complete search history.

(56) References Cited

U.S. PATENT DOCUMENTS 6,052,112 A * 4/2000 Tanaka et al. ..... 345/89
6,243,073 B1 6/2001 Kawamura et al.
6,831,634 B1 * 12/2004 Shigeta ..... 345/213
2003/0048242 A1 * 3/2003 Jeong et al. ..... 345/63
2003/0214464 A1 * 11/2003 Lim et al. ..... 345/60

FOREIGN PATENT DOCUMENTS

| | | | |
|---|---|---|---|
| DE | 198 59 678 | | 3/2000 |
| EP | 0 851 400 | | 7/1998 |
| EP | 1104190 | A1 | 5/2001 |
| EP | 1 024 663 | | 5/2005 |
| JP | 10-304281 | | 11/1998 |
| JP | 2004-274219 | * | 6/2003 |

OTHER PUBLICATIONS

Korean Office Action (Apr. 30, 2005).
European Search Report dated Jan. 25, 2008.

* cited by examiner

*Primary Examiner*—Kevin M Nguyen
(74) *Attorney, Agent, or Firm*—KED & Associates, LLP

(57) ABSTRACT

Disclosed is a method for driving a plasma display panel that can prevent flicker and double false contour in a 50 Hz driving. The method includes: providing a plurality of 50 Hz frames which are inputted using subfield weights for constructing a 60 Hz frame; and rearranging the plurality of 50 Hz frames into a plurality of 60 Hz frames.

14 Claims, 2 Drawing Sheets

| | | | | | | | | | | | |
|---|---|---|---|---|---|---|---|---|---|---|---|
| SW | SW | SW | SW | SW | SW | SW | SW | SW | SW | SW | SW |
| 1 | 2 | 4 | 4 | 8 | 16 | 30 | 35 | 40 | 45 | 1 | 2 |

| | | | | | | | | | | | |
|---|---|---|---|---|---|---|---|---|---|---|---|
| SW | SW | SW | SW | SW | SW | SW | SW | SW | SW | SW | SW |
| 4 | 4 | 8 | 16 | 30 | 35 | 40 | 45 | 1 | 2 | 4 | 4 |

| | | | | | | | | | | | |
|---|---|---|---|---|---|---|---|---|---|---|---|
| SW | SW | SW | SW | SW | SW | SW | SW | SW | SW | SW | SW |
| 8 | 16 | 30 | 35 | 40 | 45 | 1 | 2 | 4 | 4 | 8 | 16 |

| | | | | | | | | | | | |
|---|---|---|---|---|---|---|---|---|---|---|---|
| SW | SW | SW | SW | SW | SW | SW | SW | SW | SW | SW | SW |
| 30 | 35 | 40 | 45 | 1 | 2 | 4 | 4 | 8 | 16 | 30 | 35 |

| | | | | | | | | | | | |
|---|---|---|---|---|---|---|---|---|---|---|---|
| SW | SW | SW | SW | SW | SW | SW | SW | SW | SW | SW | SW |
| 40 | 45 | 1 | 2 | 4 | 4 | 8 | 16 | 30 | 35 | 40 | 45 |

Fig.3
| | | | | | | | | | | | |
|---|---|---|---|---|---|---|---|---|---|---|---|
| SW | SW | SW | SW | SW | SW | SW | SW | SW | SW | SW | SW |
| 1 | 2 | 4 | 4 | 8 | 16 | 30 | 35 | 40 | 45 | 1 | 2 |
| | | | | | | | | | | | |
|---|---|---|---|---|---|---|---|---|---|---|---|
| SW | SW | SW | SW | SW | SW | SW | SW | SW | SW | SW | SW |
| 4 | 4 | 8 | 16 | 30 | 35 | 40 | 45 | 1 | 2 | 4 | 4 |
| | | | | | | | | | | | |
|---|---|---|---|---|---|---|---|---|---|---|---|
| SW | SW | SW | SW | SW | SW | SW | SW | SW | SW | SW | SW |
| 8 | 16 | 30 | 35 | 40 | 45 | 1 | 2 | 4 | 4 | 8 | 16 |
| | | | | | | | | | | | |
|---|---|---|---|---|---|---|---|---|---|---|---|
| SW | SW | SW | SW | SW | SW | SW | SW | SW | SW | SW | SW |
| 30 | 35 | 40 | 45 | 1 | 2 | 4 | 4 | 8 | 16 | 30 | 35 |
| | | | | | | | | | | | |
|---|---|---|---|---|---|---|---|---|---|---|---|
| SW | SW | SW | SW | SW | SW | SW | SW | SW | SW | SW | SW |
| 40 | 45 | 1 | 2 | 4 | 4 | 8 | 16 | 30 | 35 | 40 | 45 |
Fig.4A
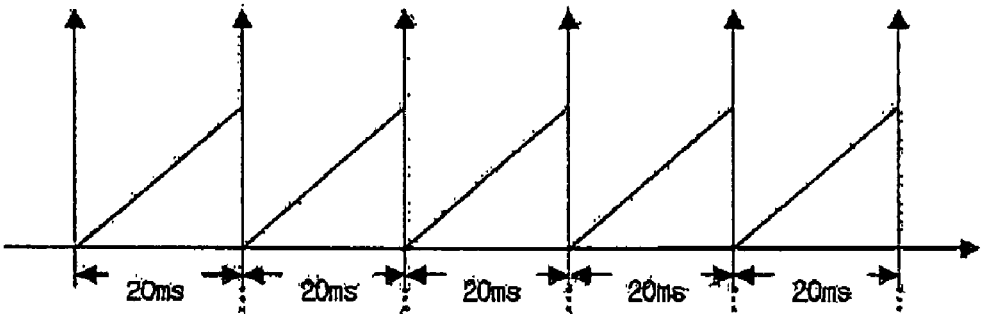
Fig.4B
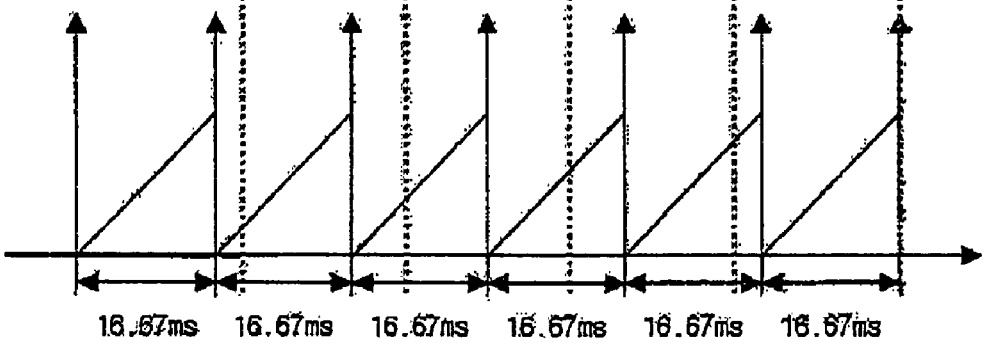

METHOD FOR DRIVING PLASMA DISPLAY PANEL

BACKGROUND OF THE INVENTION

1. Field of the Invention

The present invention relates to a plasma display panel, and more particularly, to a method for driving a plasma display panel that can eliminate moving picture noise in a 50 Hz driving method.

2. Description of the Related Art

Recently, a plasma display panel (PDP), which is one of flat panel displays, is in the limelight because it is expected to be easily capable of realizing a large-sized panel. The PDP displays an image by controlling a discharge period of each pixel according to digital data. The discharge period may be determined by the number of sustain pulses having subfield weight.

An alternate type PDP is a representative of such PDPs, and is provided with three electrodes and driven by an alternative voltage. The alternate type PDP is driven by an address-display separated (ADS) driving method so as to display an image. The ADS driving method can express a desired gray scale according to sequence of subfields, sub-field weight, and the number of sustain pulses.

However, the ADS driving method may cause problems due to motion artifacts, large area flicker, and variation in the number of gray scales. The motion artifacts are caused by dynamic false contour and motion blurring. The dynamic false contour is due to a non-linear method temporarily used for displaying gray scale, and the motion blurring is due to light emitting from each pixel during a time longer than an overall frame time.

FIG. 1 shows graphs illustrating a related art PDP driving method. In FIG. 1, a frame driven at a frequency of a 50 Hz is shown. A 50 Hz driving method is generally used in Europe and a 60 Hz driving method is used in Republic of Korea, USA, etc.

As shown in FIG. 1, the related art PDP driving method includes dividing a 20 ms frame driven at 50 Hz into two 10 ms frames driven at 100 Hz, and rearranging subfields included in each frame. For example, the 20 ms frame includes eight different subfields. A first frame of 10 ms consists of first, third, fifth and seventh subfields, and a second frame of 10 ms consists of second, fourth, sixth and eighth subfields. Thus, when the 20 ms frame driven at 50 Hz is modulated into two 10 ms frames driven at 100 Hz, large area flicker that is a large area screen flicker phenomenon occurring in the 50 Hz driving method can be prevented, and subfield weights accumulated on a retina by adjacent main frames in the 100 Hz driving are effectively dispersed thereby offsetting the dynamic false contour.

However, since the driving method shown in FIG. 1 allows an XGA single scan PDP panel and a HD PDP panel to have a limitation in the number of subfields, it is difficult to apply the 100 Hz driving method to the XGA single scan PDP panel and the HD PDP panel. Also, the lack of the number of the subfields causes a serious quantization in a low gray scale region Further, since one frame is divided into two frames, double false contour may be caused.

FIG. 2 is a schematic view exemplarily showing a related art PDP driving method.

As shown in FIG. 2, the related art PDP driving method divides one 50 Hz frame into two 50 Hz frames. In other words, the driving method of FIG. 1 divides one 50 Hz frame into two 100 Hz frames, whereas the driving method of FIG. 2 divides one 50 Hz frame into two 50 Hz frames. Accordingly, in the driving method of FIG. 2, though one frame is divided into two frames, the driving method is maintained in 50 Hz driving without any change. In other words, one 50 Hz frame is divided into two 100 Hz frames, but since data can be displayed only during half of each frame, the 50 Hz frame is resultantly divided into two 50 Hz frames.

Thus, when the 50 Hz frame is divided into two 50 Hz frames, the lowest brightness weight of the first frame (10 ms) is different than the lowest brightness weight of the second frame (10 ms), and the remaining brightness weights of the first frame are the same as those of the second frame. Also, the first and second frames are arranged having symmetric brightness weights. Accordingly, large area flicker occurring in the 50 Hz driving can be minimized.

However, since the related art PDP driving method of FIG. 2 divides one frame into two frames, double false contour may be caused. In other words, the division of the first and second frames functions to change 50 Hz into 50 Hz, but since real data is identically repeated in two frames to reproduce a moving picture, so that double false contour occurs, thereby lowering video resolution.

SUMMARY OF THE INVENTION

Accordingly, the present invention is directed to a method for driving a plasma display panel using a 50 Hz driving.

An object of the present invention is to provide a method for driving a plasma display panel that can prevent flicker and double false contour in a 50 Hz driving, Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for driving a plasma display panel using a 50 Hz driving, including: providing a plurality of 50 Hz frames which are inputted using subfield weights for constructing a 60 Hz frame; and rearranging the plurality of 50 Hz frames into a plurality of 60 Hz frames.

Each of the plurality of 60 Hz frames may have the same subfield weights.

The subfield weights for constructing the 60 Hz frame may be obtained from the plurality of 50 Hz frames set on a mapping table.

Preferably, the plurality of 50 Hz input frames correspond to the plurality of 50 Hz frames set on the mapping table.

When the plurality of 50 Hz input frames are five, six 60 Hz frames are obtained using the five 50 Hz frames set on the mapping table.

According to another aspect of the present invention, there is provided a method for driving a plasma display panel at 50 Hz, the method including: sequentially receiving a plurality of 50 Hz frames; rearranging the plurality of 50 Hz frames into a plurality of 60 Hz frames using a plurality of 50 Hz frame previously set on the mapping table; and expressing a gray scale according to the plurality of 60 Hz frames.

Each of the plurality of 50 Hz frames set on the mapping table may include subfield weights constructing one 60 Hz frame and subfield weights constructing a part of other 60 Hz frames. Each of the plurality of 50 Hz frames set on the mapping table may include subfield weights constructing a part of one 60 Hz frame and subfield weights constructing a part of other 60 Hz frames.

It is to be understood that both the foregoing general description and the following detailed description or the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 3 illustrates mapping tables including subfield weights according to an embodiment of the present invention; and FIGS. 4A and 4B illustrate a rearrangement of frames in a method for driving a plasma display panel according to the present invention.

DETAILED DESCRIPTION OF THE INVENTION

Figure 1:
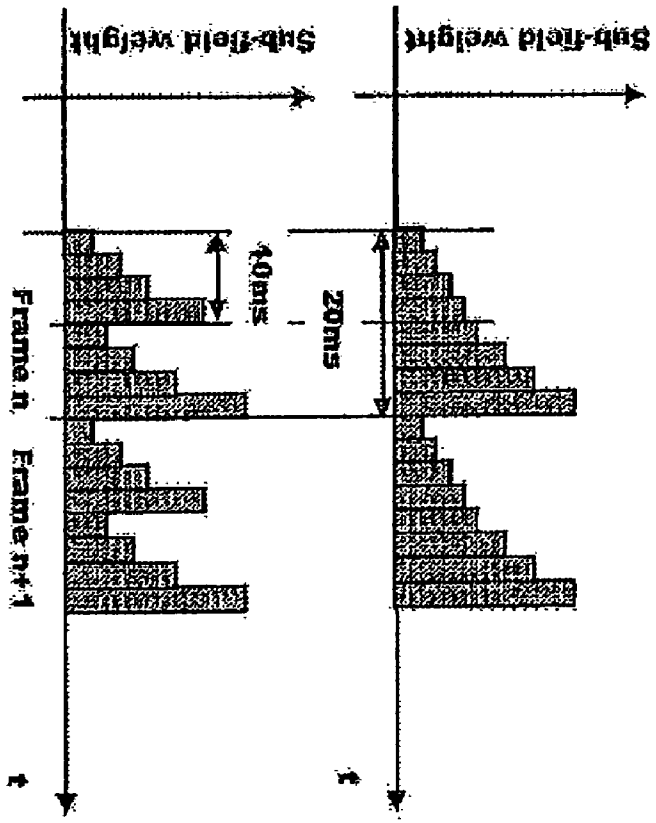
Fig.1 Related Art
FIG. 1 shows graphs illustrating a related art PDP driving method.
Figure 2:
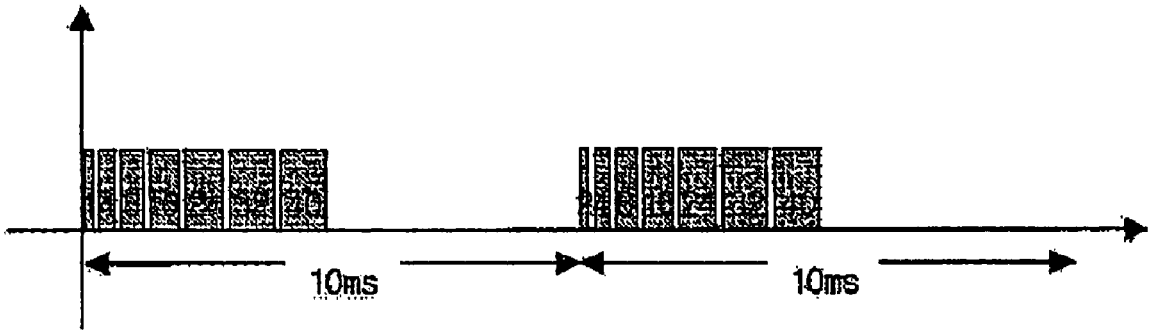
Fig.2 Related Art
FIG. 2 is graphs illustrating another related art PDP driving method.

Reference will now be made in detail to the preferred embodiments of the present invention, examples of which are illustrated in the accompanying drawings.

The present invention provides a method for driving a plasma display panel that can solve a flicker and a false contour, which occur in a 50 Hz driving method. According to the driving method of the present invention, five 50 Hz frames are rearranged into six 60 Hz frames. The driving method uses the 50 Hz driving method as it is and the frames are driven at 50 Hz.

For this purpose, five mapping tables corresponding to five 50 Hz frames may be provided in a memory within a system for driving a PDP.

FIG. 3 is a view of mapping tables including subfield weights according to an embodiment of the present invention.

Referring to FIG. 3, five mapping tables are provided in a memory within a system for driving a PDP according to the present invention. Each mapping table includes frames assigned for 50 Hz driving. Accordingly, each mapping table has one 50 Hz frame. That is, a first frame driven at 50 Hz is set in a first mapping table, and a second frame driven at 50 Hz is set in a second mapping table. A third frame driven at 50 Hz is set in a third mapping table, and a fourth frame driven at 50 Hz is set in a fourth mapping table. Also, a fifth frame driven at 50 Hz is set in a fifth mapping table. Accordingly, the five frames driven at 50 Hz are received and a predetermined gray scale is expressed using the five frames with reference to the frames set on the respective mapping tables.

According to the present invention, the five 50 Hz frames are rearranged into the six 60 Hz frames.

For this purpose, five frames driven at 50 Hz are rearranged into six frames driven at 60 Hz by using subfield weights set on the 50 Hz frames of the respective mapping tables.

Here, while a period of 50 Hz frame is 20 ms, a period of 60 Hz frame is 16.67 ms. If the five 50 Hz frames are rearranged into the six 60 Hz frames, the frame period is reduced as much such that a flicker and a double false contour seldom occur.

The respective frames set on the mapping tables include twelve subfield weights. Accordingly, the five frames include a total of sixty subfield weights. At this time, subfield weights (1-2-4-4-8-16-30-35-40-45) capable of constructing one 60 Hz frame and subfield weights (1-2 or 40-45) capable of constructing a part of other 60 Hz frames are set on the first and fifth frames. Also, subfield weights capable of constructing a part of one 60 Hz frame and a part of other 60 Hz frames are set on the second to fourth frames. For example, subfield weights (4-4-8-16-30-35-40-45-1-2-4-4) are set on the second frame, subfield weights (8-16-30-35-40-45-1-2-4-4-8-16) are set on the third frames, and subfield weights (30-35-40-45-1-2-4-4-8-16-30-35) are set on the fourth frame.

In more detail, the first 50 Hz frame includes ten subfield weights (1-2-4-4-8-16-30-35-40-45) constructing the first 60 Hz frame, and two subfield weights (1-2) constructing the second 60 Hz frame. The second 50 Hz frame includes eight subfield weights (4-4-8-16-30-35-40-45) constructing the second 60 Hz frame, and four subfield weights (1-2-4-4) constructing the third 60 Hz frame. The third 50 Hz frame includes six subfield weights (8-16-30-35-40-45) constructing the third 60 Hz frame, and six subfield weights (1-2-4-4-8-16) constructing the fourth 60 Hz frame. The fourth 50 Hz frame includes four subfield weights (30-35-40-45) constructing the fourth 60 Hz frame, and eight subfield weights (1-2-4-4-8-16-30-35) constructing the fifth 60 Hz frame. Finally, the fifth 50 Hz frame includes two subfield weights (40-45) constructing the fifth 60 Hz frame, and ten subfield weights (1-2-4-4-8-16-30-35-40-45) constructing the sixth 60 Hz frame. Accordingly, the first and fifth 50 Hz frames includes all the subfield weights constructing the first and sixth 60 Hz frames. The remaining 60 Hz frames, the second to fifth 50 Hz frames can be constructed using the subfield weights set on the second to fourth 50 Hz frames.

In brief, the first and sixth 60 Hz frames (1-2-4-4-8-16-30-35-40-45) are constructed from the first and fifth 50 Hz frames. Also, the second 60 Hz frame is constructed by connecting a portion (1-2) of the first 50 Hz frame and a portion (4-4-8-16-30-35-40-45) of the second 50 Hz frame. The third 60 Hz frame is constructed by connecting a portion (1-2-4-4) of the second 50 Hz frame and a portion (8-16-30-35-40-45) of the third 50 Hz frame. The fourth 60 Hz frame is constructed by connecting a portion (1-2-4-4-8-16) of the third 50 Hz frame and a portion (30-35-40-45) of the fourth 50 Hz frame. The fifth 60 Hz frame is constructed by connecting a portion (1-2-4-4-8-16-30-35) of the fourth 50 Hz frame and a portion (40-45) of the fifth 50 Hz frame.

Therefore, the six 60 Hz frames having the ten subfield weights can be constructed with the five 50 Hz frames having the twelve subfield weights.

The driving method will now be described in brief.

First, the five 50 Hz frames are sequentially received. At this time, the five 50 Hz frames capable of constructed the six 60 Hz frames having ten subfield weights are set on the mapping tables.

Accordingly, the six 60 Hz frames are constructed using the five 50 Hz frames set on the mapping tables. While the 50 Hz frame is constructed using twelve subfield weights, the 60 Hz frame can be constructed using ten 60 Hz frames. For example, the first and sixth 60 Hz frames are constructed using the first and fifth 50 Hz frames, and the second to fourth 60 Hz frames are constructed using the second to fourth 50 Hz frames.

A predetermined gray scale is expressed according to the six 60 Hz frames.

FIGS. 4A and 4B illustrate a driving method of the PDP according to the present invention, in which the frames are rearranged. In detail, FIG. 4A illustrates an arrangement of the five 50 Hz frames, and FIG. 4B illustrates the six 60 Hz frames rearranged from the five 50 Hz frames.

Referring to FIG. 4A, if the frames are driven at 50 Hz, one frame is inputted at every one vertical synchronization signal (Vsync). The subfield weights of the frames set on the mapping tables are applied to express the gray scale on a screen. At this time, as shown in FIG. 3, each of the frames set on the mapping tables includes the twelve subfield weights. A desired gray scale is expressed by rearranging the mapping tables into the first to sixth 60 Hz frames, which are constructed with ten subfield weights, from the first to fifth frames having twelve subfield weights.

According to the prior art, however, 50 Hz frames constructed with twelve subfield weights are set on the mapping tables. Accordingly, if 50 Hz frames are inputted, a desired gray scale is expressed using the subfield weights of the frames set in the mapping tables. However, if the frames are driven at 50 Hz in this manner, a flicker and a double false contour may occur.

On the contrary, according to the present invention, when five 50 Hz frames are inputted, a desired gray scale is expressed through the rearrangement into six 60 Hz frames using five 50 Hz frames which are previously assigned so as to construct six 60 Hz frames. Referring to FIG. 4B, the first 60 Hz frame is constructed using the first 50 Hz frame, which is inputted in response to the vertical synchronization signal (Vsync) and includes twelve subfield weights of the first mapping table.

Then, if the second 50 Hz frame is inputted, the second 60 Hz frame is constructed using the first and second 50 Hz frames having twelve subfield weights set in the first and second mapping tables.

In a similar manner, if the third 50 Hz frame is inputted, the third 60 Hz frame is constructed using the second and third 50 Hz frames having twelve subfield weights set in the second and third mapping tables.

Through these processes, if the fourth and fifth 50 Hz frames are inputted, the fourth 60 Hz frame is constructed using the third and fourth 50 Hz frames, and the fifth and sixth 60 Hz frames are constructed using the fourth and fifth 50 Hz frames. At this time, it is preferable that each of the six 60 Hz frames has the equal arrangement of the subfield weights. For example, as shown in FIG. 3, the subfield weights of each 60 Hz frame may be arranged in order of 1-2-4-4-8-16-30-35-40-45.

According to the PDP driving method of the present invention, five 50 Hz frames are rearranged into six 60 Hz frames using the subfield weights which are previously set on have 60 Hz frames. At this time, the rearranged six 60 Hz frames are not driven at 60 Hz, but they can provide the same effect as the driving at 60 Hz. Accordingly, it is possible to prevent the flicker and the double false contour occurring in the conventional 50 Hz driving. Also, it is possible to obtain the same effect of the 60 Hz driving which is now used in U.S.A and Korea. As shown in FIG. 4B, six 60 Hz frames can be constructed using the subfield weights set on five 50 Hz frames.

Although it has been described that each of the 50 Hz frames of the mapping tables includes twelve subfield weights, it is not always necessary for the 50 Hz frames to have twelve subfield weights so as to rearrange five 50 Hz frames into six 60 Hz frames. For example, six subfield weights can be arbitrarily set on each of the five 50 Hz frames. In this case, six 60 Hz frames each having five subfield weights can be constructed using the five 50 Hz frames.

According to the PDP driving method of the present invention, the frame period is reduced from 20 ms to 16.67 ms by converting an optical center of 50 Hz into that of 60 Hz, thereby eliminating the flicker phenomenon.

Also, it is possible to eliminate the double false contour occurring when 50 Hz frame, is divided into two 100 Hz frames.

Further, it is possible to the same effect as the 60 Hz driving method used in U.S.A by virtually constructing five 50 Hz frames with six 60 Hz frames, while maintaining the 50 Hz driving method used in Europe. The applications of products will be expanded because the flicker and the double false contour can be eliminated.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for driving a plasma display panel at 50 Hz, which displays a frame image having a plurality of subfield weights, the method comprising:

sequentially receiving five 50 Hz frames, wherein each frame comprises an array of a plurality of subfields having weights; and forming six 60 Hz frames by rearranging the plurality of subfields of the five 50 Hz frames, wherein a number of subfields of the 50 Hz frames are 5×N1, and a number of subfields of the 60 Hz frames are 6×N2, wherein N1 and N2 are different positive integers, and wherein N1 is greater than N2.

2. The method according to claim 1, wherein each of the 60 Hz frames has a same subfield arrangement and same subfield weights.

3. The method according to claim 1, wherein the 50 Hz input frames correspond to 50 Hz frames set in a mapping table.

4. The method according to claim 1, wherein the six 60 Hz frames are obtained using the five 50 Hz frames set in a mapping table.

5. The method according to claim 4, wherein a first 60 Hz frame is obtained from a first 50 Hz frame set in the mapping table.

6. The method according to claim 4, wherein a sixth 60 Hz frame is obtained from a fifth 50 Hz frame set in the mapping table.

7. The method according to claim 4, wherein second to fifth 60 Hz frames are obtained from second to fourth 50 Hz frames set in the mapping table.

8. The method according to claim 4, wherein first to fifth 50 Hz frames set in the mapping table comprise subfield weights constructing one 60 Hz frame and subfield weights constructing a part of other 60 Hz frames.

9. The method according to claim 4, wherein second to fourth 50 Hz frames set in the mapping table comprise subfield weights constructing a part of one 60 Hz frame and subfield weights constructing a part of other 60 Hz frames.

10. The method according to claim 1, wherein N1 indicates twelve subfield weights and N2 indicates ten subfield weights.

11. The method according to claim 1, a total number of subfields of the five 50 Hz frames are the same as a total number of subfields of the six 60 Hz frames.

12. A method for driving a plasma display panel at 50 Hz, the method comprising:

sequentially receiving five 50 Hz frames previously set on a mapping table, wherein each frame comprises an array of a plurality of subfields having weights;

forming six 60 Hz frames by rearranging the plurality of subfields of the five 50 Hz frames, wherein the subfields constructing each of the frames of the six 60 Hz frames have a same arrangement and weights; and expressing a gray scale according to the six 60 Hz frames.

13. The method according to claim 12, wherein each of the 50 Hz frames set in the mapping table comprises subfield weights constructing one 60 Hz frame and subfield weights constructing a part of other 60 Hz frames.

14. The method according to claim 12, wherein each of the 50 Hz frames set in the mapping table comprises subfield weights constructing a part of one 60 Hz frame and subfield weights constructing a part of other 60 Hz frames.

* * * * *